US010984765B1

(12) United States Patent
Abissi

(10) Patent No.: US 10,984,765 B1
(45) Date of Patent: Apr. 20, 2021

(54) TROMBONE SLIDE EXTENSION HANDLE

(71) Applicant: Extendabone, LLC, Tenafly, NJ (US)

(72) Inventor: Nicole Elise Abissi, Tenafly, NJ (US)

(73) Assignee: Extendabone, LLC, Tenafly, NJ (US)

( * ) Notice: Subject to any disclaimer, the term of this patent is extended or adjusted under 35 U.S.C. 154(b) by 0 days.

(21) Appl. No.: 16/789,332

(22) Filed: Feb. 12, 2020

(51) Int. Cl.
*G10D 9/00* (2020.01)
*G10D 7/10* (2006.01)

(52) U.S. Cl.
CPC ..... *G10D 9/00* (2013.01); *G10D 7/10* (2013.01)

(58) Field of Classification Search
CPC ..... G10D 9/00; G10D 7/10
See application file for complete search history.

(56) References Cited

FOREIGN PATENT DOCUMENTS

GB 1003389 A * 9/1965 ..... G10D 7/10

* cited by examiner

*Primary Examiner* — Kimberly R Lockett

(57) ABSTRACT

A trombone slide extension handle includes a handle portion, a neck portion, and a connector portion. The handle portion is a generally-oval shaped form sized to accommodate a human hand, and a groove portion shaped to accommodate fingertips of the human hand. The connector portion includes an open-ended, generally cylindrical connector having a wall portion with a circumference of approximately 270 degrees, and an opening portion between ends of the wall portion, the connector sized to accommodate a trombone slide handle and to securely hold the trombone slide handle, the ends capable of separation to attach to and be removed from the trombone slide handle.

10 Claims, 9 Drawing Sheets

TROMBONE SLIDE EXTENSION HANDLE

BACKGROUND

Trombones, such as trombone 100 shown in FIGS. 8 and 9, typically include a manually operated slide 101 that is moved toward or away from the musician, who uses trombone slide handle, or post, 103 to effectuate such movement. However, the range of motion required of the slide 101 for many musical compositions is such that musicians with short arms have difficulty achieving the desired slide extension.

SUMMARY

A trombone slide extension handle includes a handle portion, a neck portion, and a connector portion. The handle portion is a generally-oval shaped form sized to accommodate a human hand, and an upper groove portion shaped to accommodate fingertips of the human hand. The neck portion includes a tapered bi-planar form, and a lower groove portion extending from the upper groove portion. The connector portion includes a generally cylindrical connector having a longitudinal wall portion terminating in longitudinal wall ends defining a longitudinal opening sized to accommodate a trombone slide handle. In an aspect, the wall portion has a circumference of approximately 270 degrees. Thus, the connector portion is sized to accommodate a trombone slide extension and to securely hold the trombone slide extension, the longitudinal opening capable of separation to allow the connector portion to attach to and to be removed from the trombone slide handle.

A trombone slide extension handle includes a handle portion, which in turn includes a generally-oval shaped form sized to accommodate a human hand, and an upper groove portion shaped to accommodate fingertips of the human hand. The extension handle also includes a neck portion, which in turn includes a tapered form, and a lower groove portion coupled to the upper groove portion and shaped to accommodate fingertips of the human hand. Finally, the extension handle includes a connector portion, which in turn includes an open, generally cylindrical connector having a wall portion with a circumference sized and shaped to accommodate a trombone slide handle. In an aspect, the cylindrical wall portion may extend for approximately 270 degrees, with the connector forming a channel for seating the trombone slide handle, and having an opening portion between ends of the wall portion, whereby the connector securely holds the slide handle. Wall ends of the cylindrical wall portion may be capable of separation to attach to and to be removed from the slide handle. The connector may include a flexible, longitudinal lip formed at one of the wall ends, the lip, when operated, causing the wall ends to spread apart to accommodate the trombone slide handle, wherein the wall ends close when the trombone slide handle seats in the connector.

A trombone slide extension handle includes a handgrip portion and a slide handle connection portion. The handgrip portion and the slide handle portion are connected by a neck portion. The slide handle connection portion is pivotably connected to the trombone slide handle (sometime referred to as a brace or post). The connection portion includes a connector having a cylindrical form open on its ends and open longitudinally for approximately 90 degrees of its circumference. In an embodiment, the longitudinal opening is capable of enlarging slightly, because of the semi-flexible construction of the connector, to achieve an enlarged opening sized to accommodate a trombone slide handle. In this embodiment, the spring action of the connector opening provides a secure connection between the extension handle and the trombone slide handle. In another embodiment, the opening is sized such that enlarging the opening through flexion of the connector may not be required. In this later embodiment, the trombone slide handle is secured to the connector and thus the extension handle by operation of one or more locking devices that are internally-threaded, and that engage corresponding external threads on one or more ends of the connector. When partially or fully engaged, the one or more locking devices, in cooperation with the connector, provide a 360-degree closure around the trombone slide handle.

In an embodiment, to accommodate trombone slide handles with different diameters, an extension handle may be provided as a kit. The kit may include any one the extension handle, with the supplied extension handles having connectors with a fixed internal diameter but with an opening that, due to the semi-flexible construction of the extension handle, may spring open and snap back to secure the trombone slide handle. For trombone slide handles that may be sufficiently smaller in outside diameter than the connector internal diameter, while still larger in diameter than the width of the connector opening in its relaxed position, the kit may include one or more sleeves, each sleeve having a different thickness, the sleeves having the same cylindrical shape, with opening, as the connector, the sleeves configured to be inserted into the connector to make a tighter fit with the trombone slide handle, as desired by the musician.

DESCRIPTION OF THE DRAWINGS

The detailed description refers to the following figures in which like numerals refer to like items, and in which.

DETAILED DESCRIPTION

Figure 8:
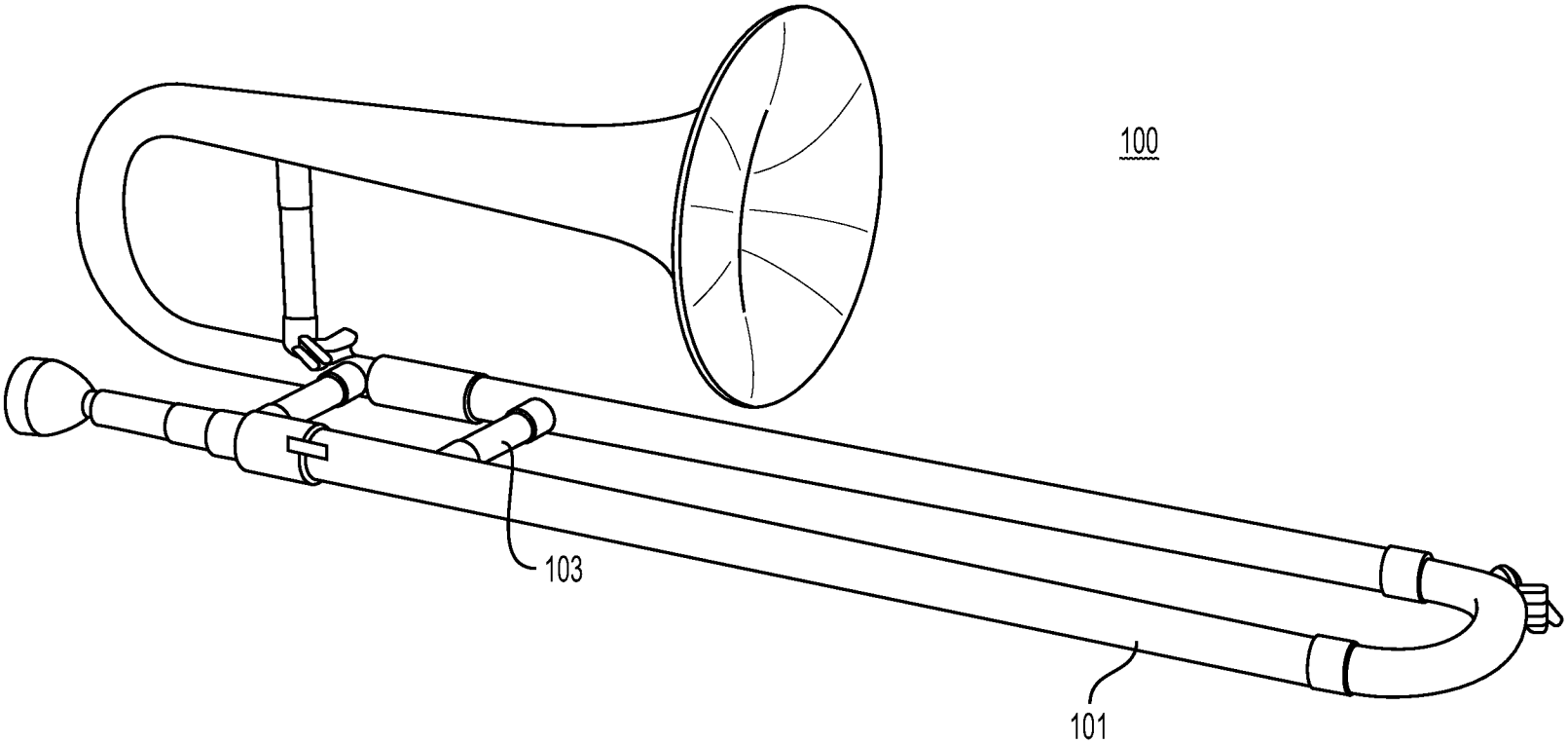
FIG. 8 (PRIOR ART)
FIGS. 8 and 9 illustrate a typical trombone.
Figure 9:
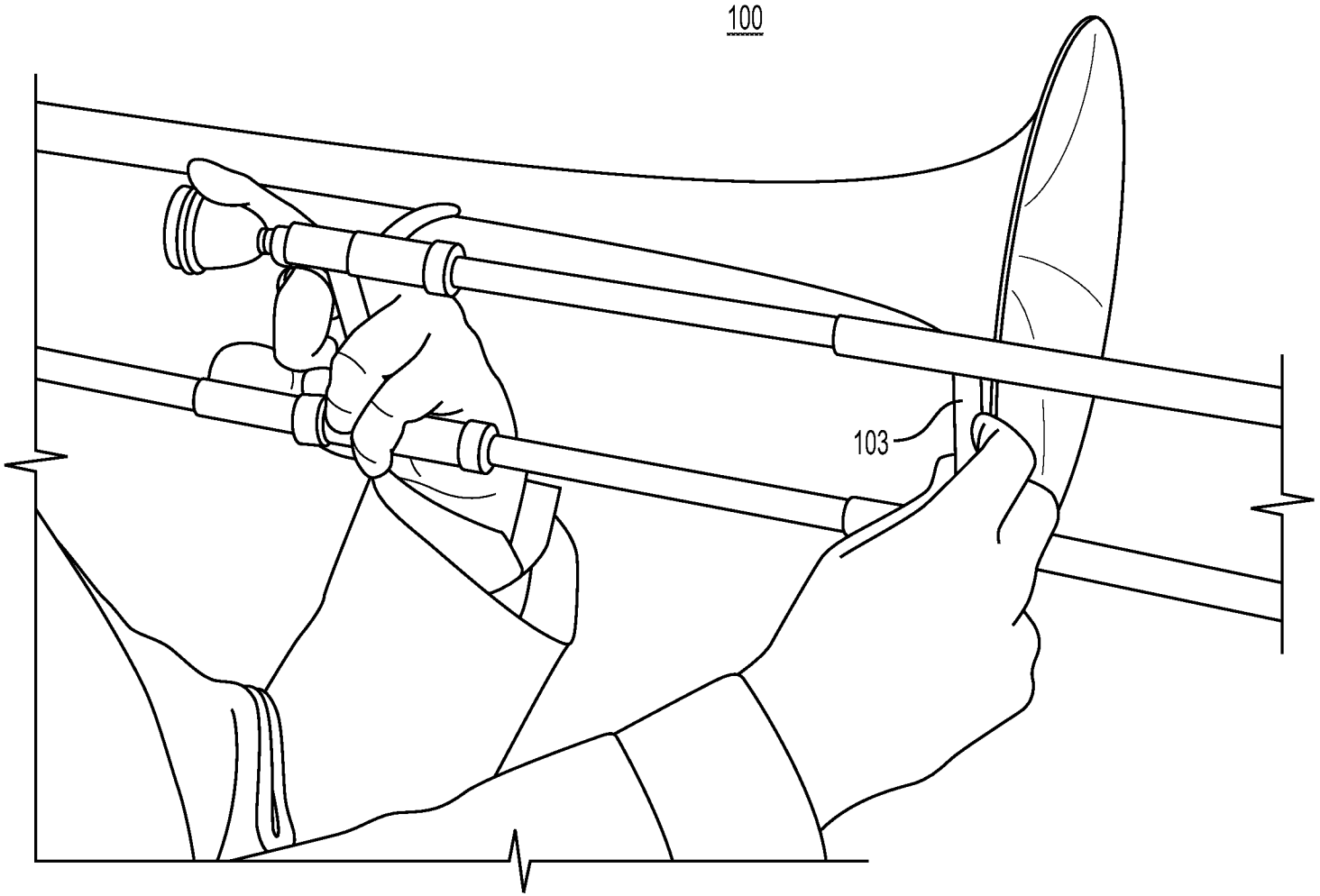
FIG. 9 (PRIOR ART)

A typical trombone is illustrated in FIGS. 8 and 9. The trombone slide 101 is extended and retracted when a musician grips trombone slide handle, or post, 103, and moves the trombone slide away from or toward himself. The illustrated trombone 100 presents challenges to musicians having short arms, such as, for example, children. To address use limitations of trombones such as the trombone 100, disclosed herein are embodiments of a trombone slide extension handle that allows musicians to achieve a desired range of motion of the trombone slide 101.

Figure 1:
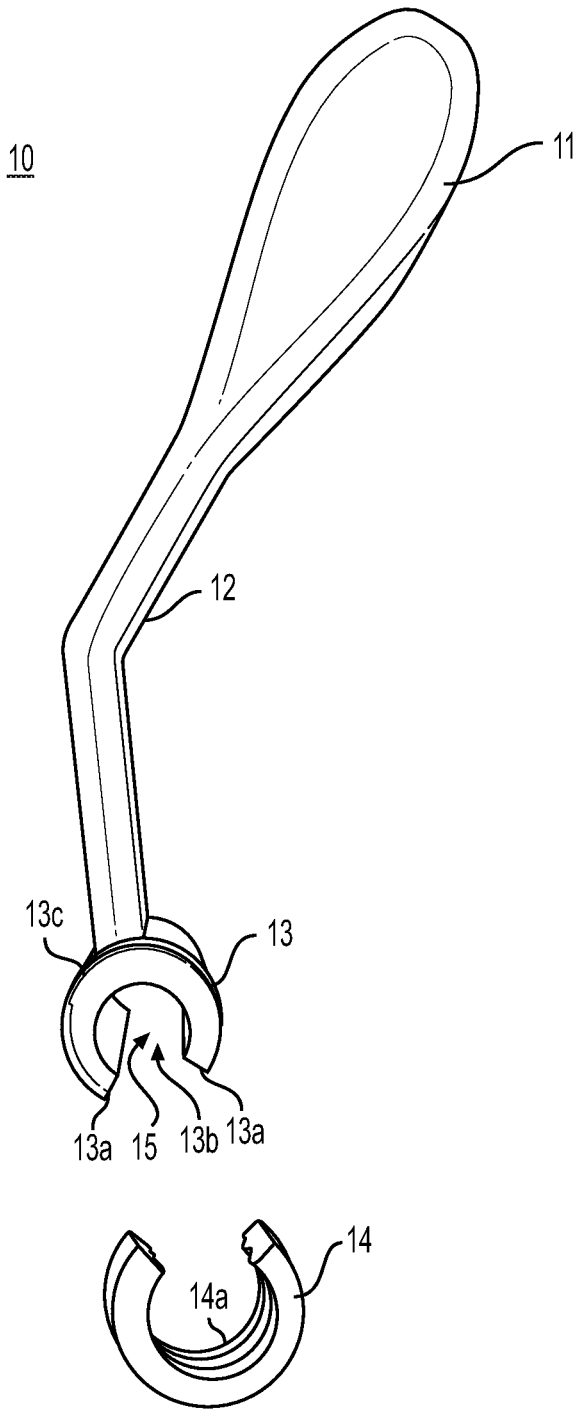
FIGS. 1-3 illustrate an embodiment of a slide extension handle.
Figure 2:
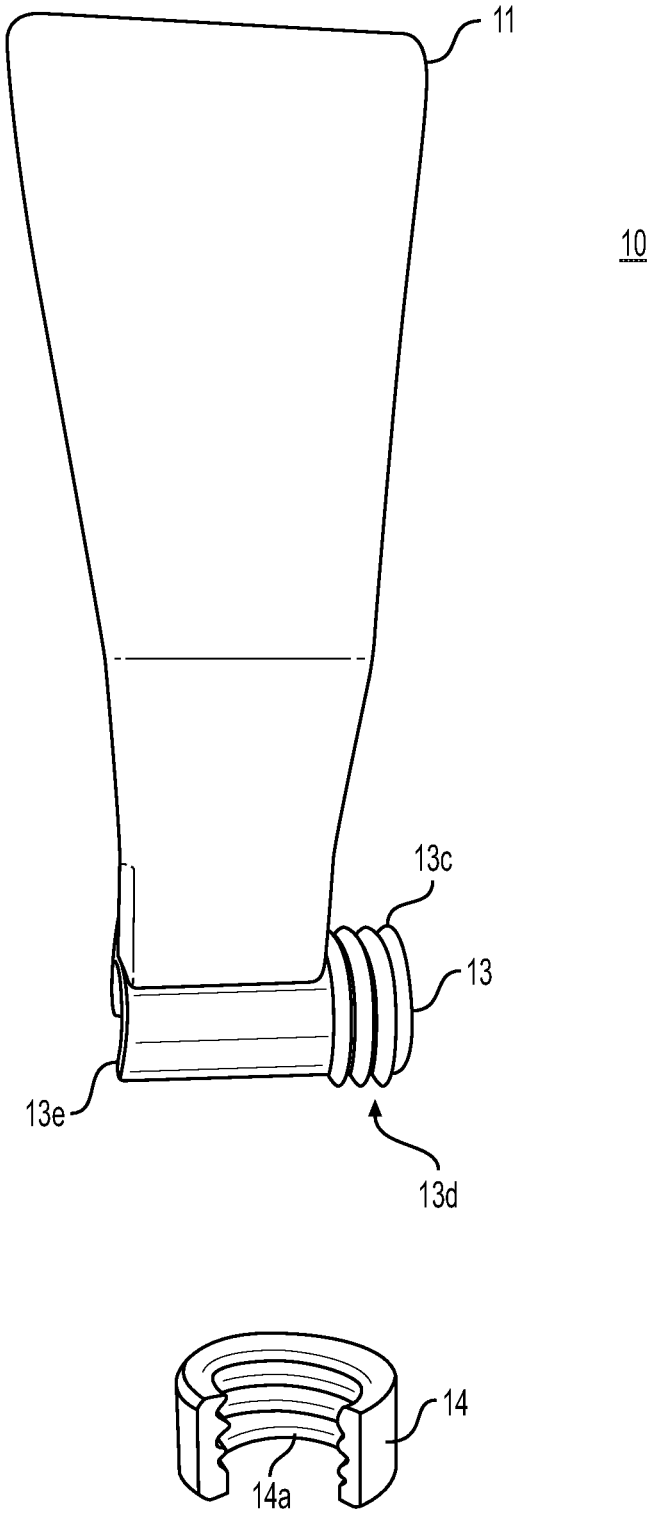
Figure 3:
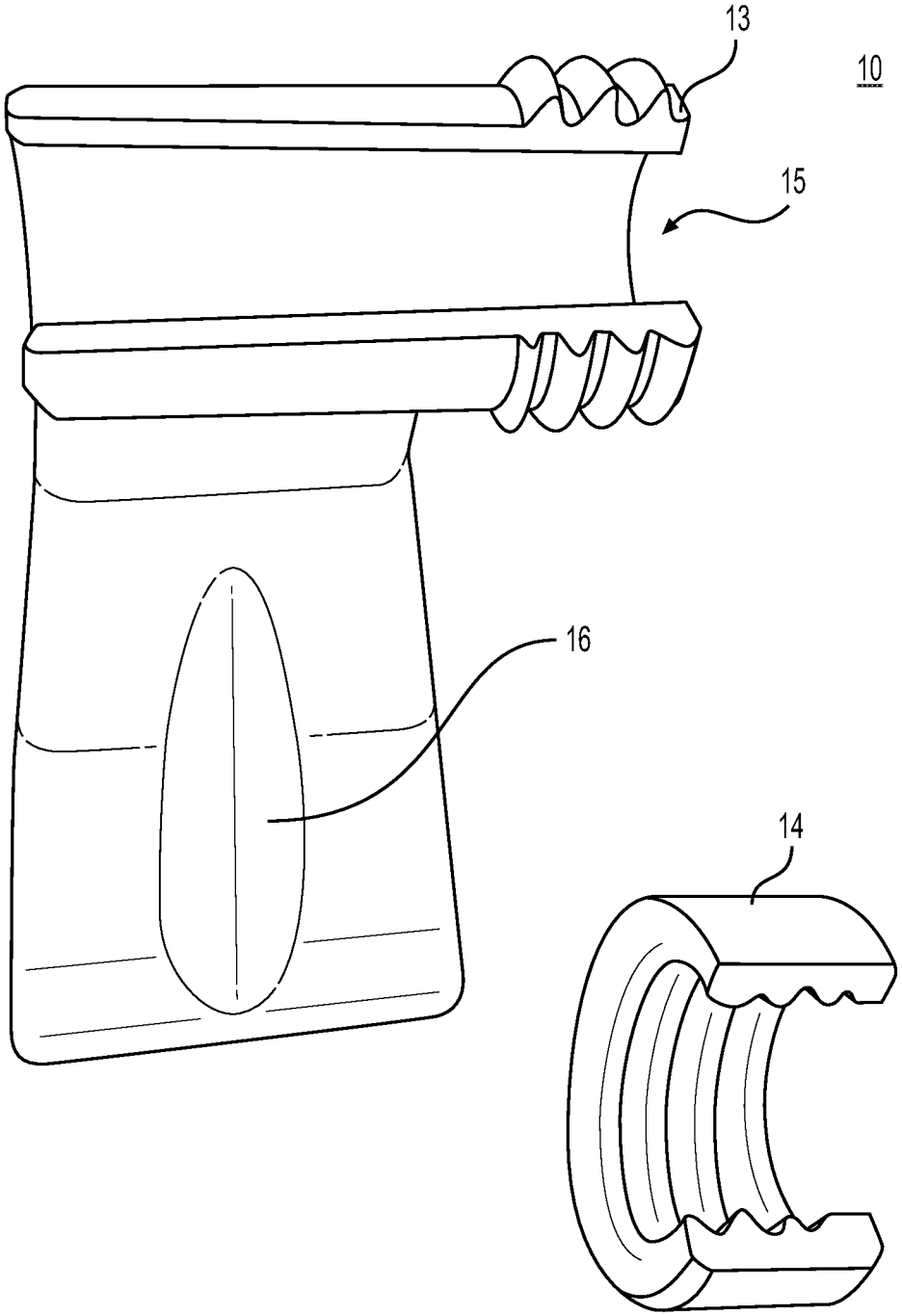

FIGS. 1-3 illustrate an embodiment of a trombone slide extension handle useable with the trombone 100 of FIGS. 8 and 9. FIG. 1 presents a side view of the trombone slide extension handle; FIG. 2 presents a "bottom" view of the extension handle; and FIG. 3 presents a "top" view of the extension handle. Turning to FIG. 1, trombone slide extension handle 10 can be seen to include a handle portion 11, a neck portion 12, and a connector portion that includes connector 13 and securing device 14. The connector 13 has a generally open cylindrical form (open at a top and at a bottom of the cylindrical form), with a cylindrical wall of the connector 13 extending circumferentially for greater than 180 degrees to form cylindrical channel 15 so as to securely attach the extension handle 10 to the trombone slide handle 103. For example, the cylindrical wall of the connector 13 may extend approximately 270 degrees, terminating at ends 13*a*, which define longitudinal opening or gap 13*b*. Generally, the cylindrical connector wall terminates at an opening that is sized to allow the connector 13 to fit over trombone slide handle 103 (see FIG. 8). In an aspect, the connector longitudinal wall opening 13*b* may be enlarged while fitting the connector 13 over the trombone slide handle 103. The opening 13*b* may be capable of enlargement by use of a flexible or semi-flexible material in forming the extension handle 10. That is, the connector longitudinal opening 13*b* may spring open and then snap closed to or near to its original position/size.

As can be seen in FIG. 2, the connector 13 has formed on a first longitudinal end 13*d*, external threads 13*c*. The securing device 14 can be seen to include internal threads 14*a*. The securing device 14 acts in concert with the enclosing wall of the connector 13 to secure the extension handle 10 to the slide handle 103. The securing device 14 thus is threaded onto the connector 13 to further secure the extension handle 10 to the trombone slide handle 103, and the extension handle 10 remains connected to the trombone handle 103 as long as the securing device 14 is at least partially threaded onto the connector 13. In operation, the securing device 14 may be threaded onto the connector 13 so that the internal and external threads 13*c* and 14*a*, respectively, are fully engaged (i.e., the securing device 14 cannot be threaded further). The assembled connector portion thus forms circular channel 15 that securely wraps around a portion of the slide handle 103; for example, the connector 13 may wrap around approximately 270 degrees of the slide handle 103, with the connector 13 and the securing device 14, when partially or fully threaded on, covering 360 degrees over a length of the slide handle 103. The connector portion, when thus assembled, not only prevents the extension handle 10 from disengaging the slide handle 103, but also allows the extension handle 10 to pivot about the slide handle 103, thereby accommodating movement of the trombone slide 101 toward and away from the musician.

In an aspect, the connector 13 may be extended longitudinally to accommodate a second securing device (not shown) at end 13*e* (see FIG. 2), and the extension handle 10 may include securing devices 14 on both longitudinal ends 13*d* and 13*e* of the connector 13.

Features of the extension handle 10, shown in FIGS. 1-3, allow the musician to generate sufficient force to move the trombone slide from a fully retracted position to a fully extended position. First, the handle extension handle 10 is formed from a material that provides sufficient elasticity for ends 13*a* of the connector 13 to spread apart, thereby opening gap 13*b*, when the connector 13 is inserted onto the trombone handle 103. Once the trombone handle 103 is nested within the channel 15, the ends 13*a* spring back, or close toward each other, returning the connector 13 to, or close to, its original shape and the connector's opening 13*b* to, or close to, its original size. This feature provides a sufficiently tight closure on the trombone slide handle 103 so as to prevent wobble of the extension handle 10. However, the channel 15 has sufficient diameter to allow the extension handle 10 to pivot or rotate freely about the trombone slide handle 103. A second feature is the generally oval shape or cross-section of the handle portion 11 (best seen in FIG. 1), which is designed to fit comfortably in the musician's hand and to have a sufficient volume to so as to allow movement of the trombone slide without requiring the musician to apply much pressure to the extension handle 10. A third feature is the shape of the neck 12. As can be seen in FIG. 1, the neck 12 has a dog-leg shape. The dog-leg shape enables more efficient application of force to move the trombone slide 101 throughout its intended range of motion. The dog-leg shape also allows easier insertion of the extension handle 10 on to the trombone slide handle 103 as well as easier removal than would occur were the neck 12 flat. It also enables the handle to be more easily held when the trombone slide is fully retracted. A fourth feature is groove 16, best seen in FIG. 3. Groove 16 accommodates the musician's finger tips, allowing the musician to maintain a sure grip on the extension handle 10. The grove 16 is shown extending along the handle portion and the neck portion of the extension handle 10.

Figure 4:
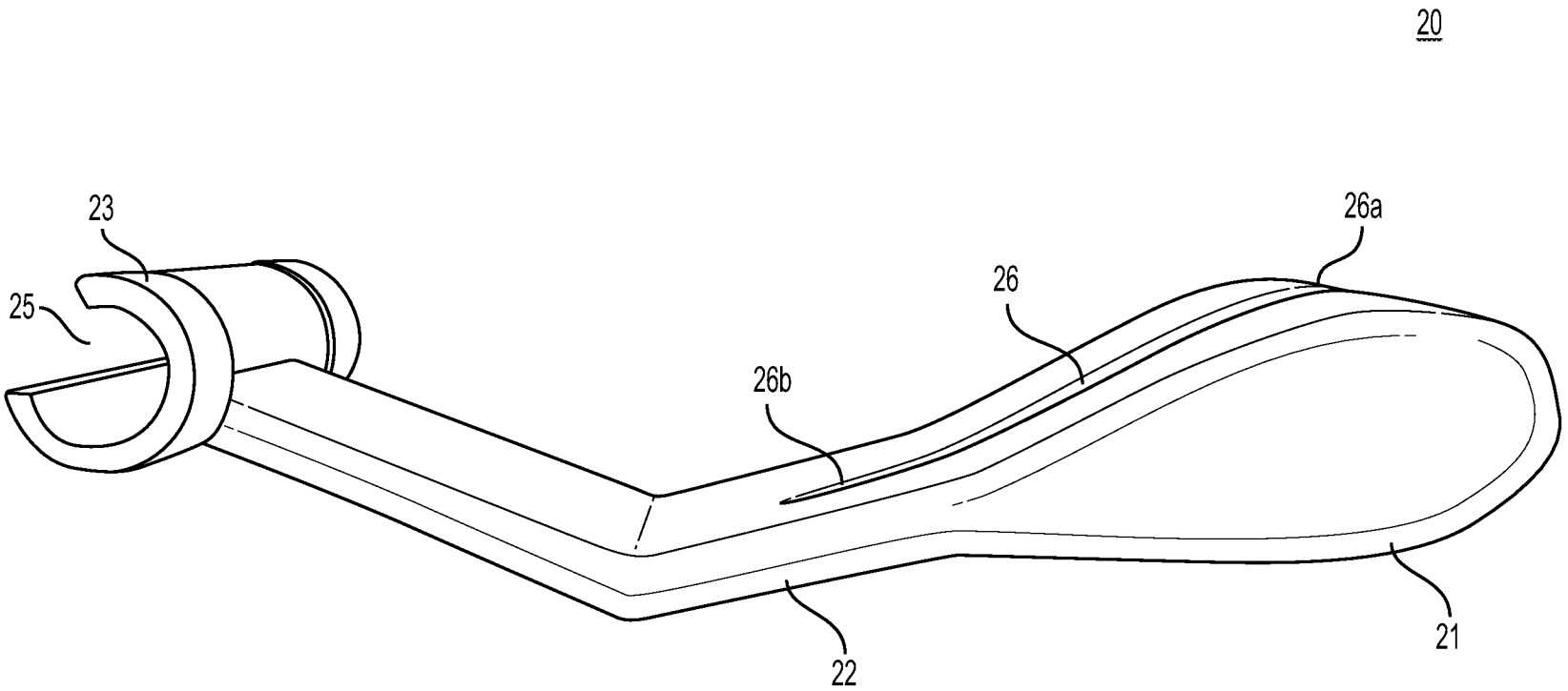
FIGS. 4 and 5 illustrate another embodiment of a slide extension handle.
Figure 5:
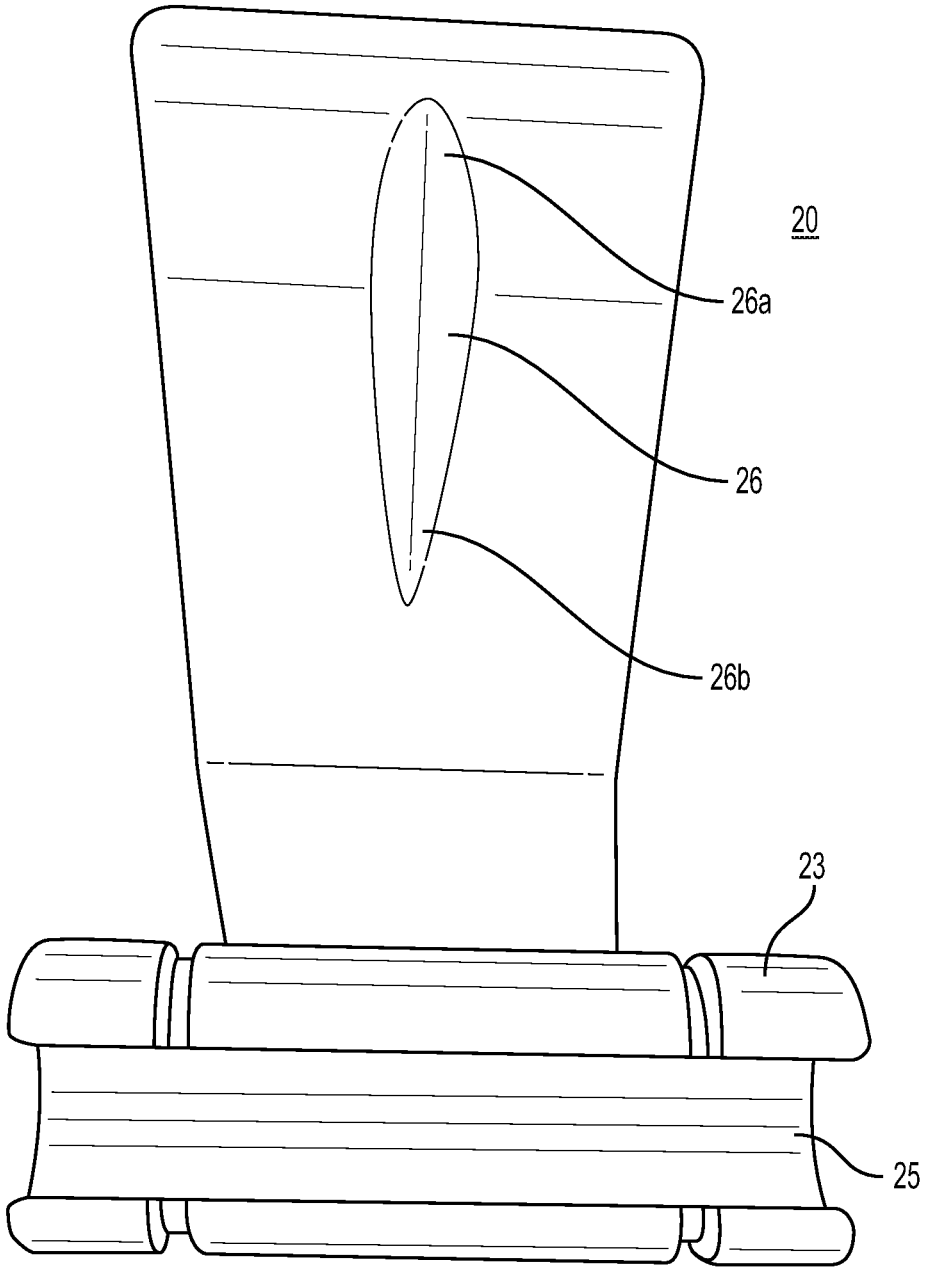

FIGS. 4 and 5 illustrate another embodiment of a trombone slide extension handle. In FIG. 5, extension handle 20 includes generally-oval-shaped handle portion 21, dog leg-shaped neck 22, open cylindrical connector 23, which forms cylindrical channel 25. Extension handle 20 differs from extension handle 10 at least in the respect that extension handle 20 contains no moveable parts, and does not rely on an explicit, separate locking or closing mechanism such as device 14. In most other respects, the features and capabilities enabled by the structure of the extension handle 10 apply equally to the extension handle 20. For example, the open cylindrical connector 23 has enough flexibility to spring open sufficiently that when sprung open, the longitudinal opening is approximately as large as the diameter of the connector 23, thereby enabling the extension handle 20 to securely grip the trombone slide handle 103 while allowing for easy installation and removal of the extension handle 20. Furthermore, as can be seen in FIG. 5, the extension handle 20 includes groove 26, comprising upper groove portion 26*a* and lower groove portion 26*b*, with the groove 26 performing the same functions as groove 16 of extension handle 10.

Figure 6:
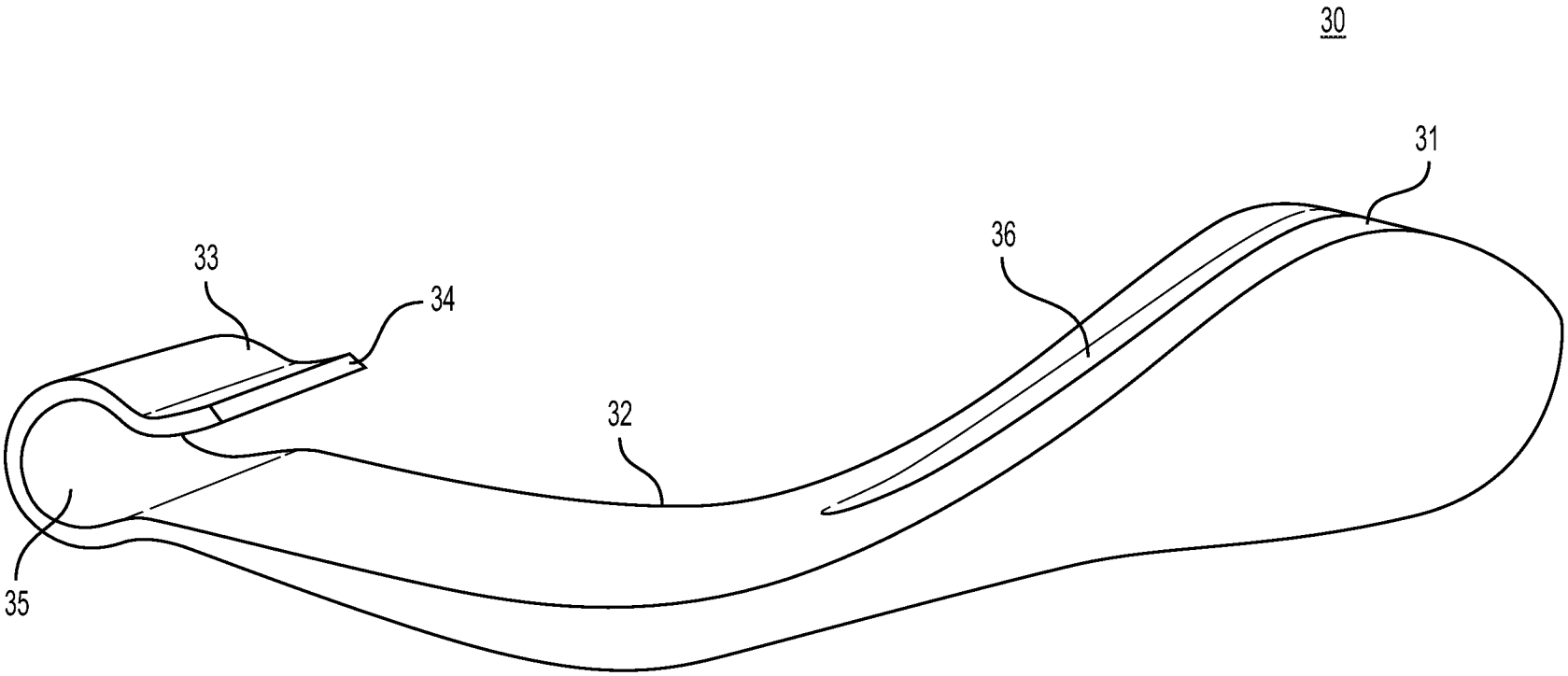
FIGS. 6 and 7 illustrate yet another embodiment of a slide extension handle.
Figure 7:
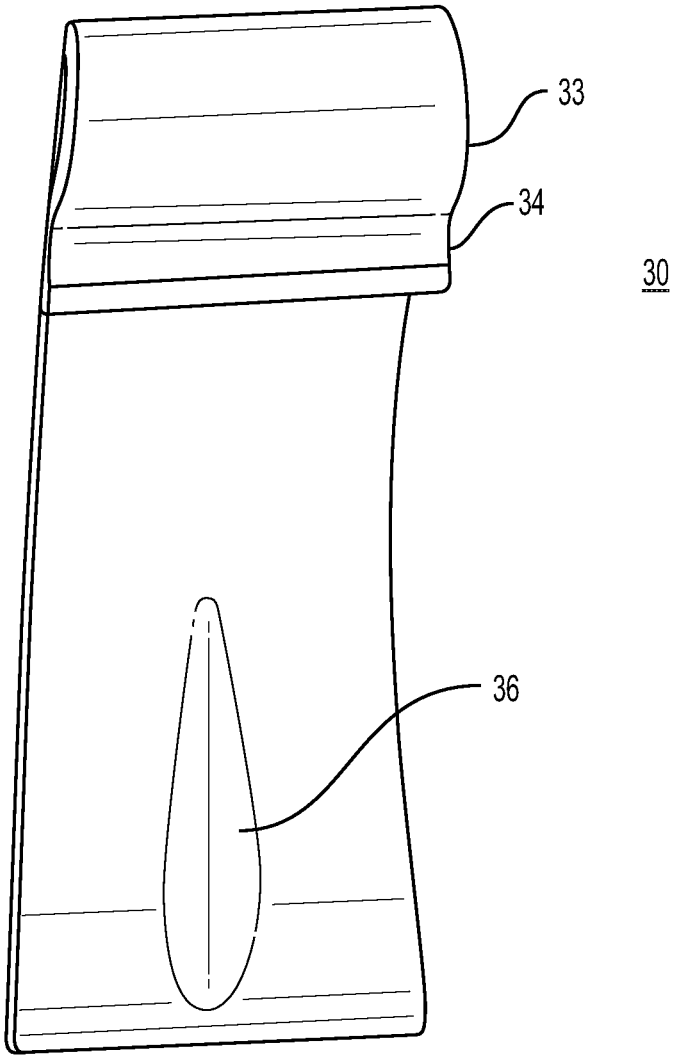

FIGS. 6 and 7 illustrate yet another embodiment of a trombone slide extension handle. In FIG. 6, extension handle 30 includes generally-oval-shaped handle portion 31, neck 32, and generally cylindrical connector 33, which forms open cylindrical channel 35. In addition, formed with the connector 33 is lip 34. Extension handle 30 differs from extension handle 10 at least in the respect that extension handle 30 contains no moveable parts, and does not rely on an explicit, separate locking or closing mechanism such as device 14. In addition, the neck 32 is curved, as opposed to having a dog-leg form. In most other respects, the features and capabilities enabled by the structure of the extension handle 10 apply equally to the extension handle 30. For example, the generally cylindrical connector 33 has enough flexibility to spring open sufficiently that when sprung open, the opening is approximately as large as the diameter of the cylindrical connector 33, thereby enabling the extension handle 30 to securely grip the trombone slide handle 103 while allowing for easy installation and removal of the extension handle 30. However, the lip 34 formed with the connector 33 acts as a lever to more easily spring open the cylindrical connector 33. Thus, placement of the extension handle 30 onto the trombone slide handle 103 may be easier than placement of the extension handles 10 or 20. As with the other extension handles disclosed herein, as can be seen in FIG. 7, the extension handle 30 includes groove 36, which performs the same functions as groove 16 of extension handle 10 and the groove 26 of the extension handle 20.

To accommodate trombone slide handles with different diameters, one or more of the herein disclosed extension handles may be provided as a kit. The kit may include any one of the extension handles, with the supplied extension handles having connectors with a fixed internal diameter but with an opening that, due to the semi-flexible construction of the extension handle, may spring open and snap back to secure the trombone slide handle. For trombone slide handles that may be sufficiently smaller in diameter than the connector internal diameter, while still larger in diameter than the width of the connector opening in its relaxed position, the kit may include one or more sleeves, each sleeve having a different thickness, the sleeves having the same cylindrical shape, with opening, as the connector, the sleeves configured to be inserted into the connector to make a tighter fit with the trombone slide handle, as desired by the musician. Furthermore, the sleeves may be keyed to the connector so as rotate with the connector, and not rotate independently of the connector, as the trombone slide is extended and retracted.

The herein disclosed extension handles may be formed through an injection molding process, and the extension handles may be modified to permit such injection molding. For example, handle portions of the extension handles may include an open or honeycomb structure to permit injection molding. Alternately, the extension handles may be formed by 3-D printing. Finally, the neck portions of the extension handles may be formed having different lengths, as appropriate, for specific musicians.

We claim:

1. A trombone slide extension handle, comprising:
- a handle portion, comprising:
  - a generally-oval shaped form sized to accommodate a human hand, and
  - a groove portion shaped to accommodate fingertips of the human hand;
- a neck portion, comprising:
  - a tapered bi-planar form, and
  - a groove portion extension; and
- a connector portion, comprising:
  - an open-ended, generally cylindrical connector having a cylindrical wall portion terminating in longitudinal wall ends defining a longitudinal opening, and
  - the longitudinal opening and the connector sized to accommodate a trombone slide handle and to securely hold the trombone slide handle, the wall ends capable of separation to attach to and be removed from the trombone slide handle.

2. The trombone slide extension handle of claim 1, the connector portion further comprising:
- a flexible lip formed at one of the wall ends, the lip, when operated, causing the wall ends to spread apart to accommodate the trombone slide handle.

3. The trombone slide extension handle of claim 1, the connector portion further comprising:
- an externally-threaded portion on at least one longitudinal wall end of the connector; and
- an internally-threaded closure device configured to engage the externally-threaded portion, the internally-thread closure device comprising a generally cylindrical form.

4. The trombone slide extension handle of claim 3, having a longitudinal opening of the connector wall portion of approximately 270 degrees and having a closure device wall of approximately 270 degrees to coincide with the connector wall portion.

5. The trombone slide extension handle of claim 1, wherein the bi-planar for of the neck portion has a dog-leg form.

6. The trombone slide extension handle of claim 1, wherein the bi-planar form of the neck portion has a curved form.

7. A trombone slide extension handle, comprising:
- a handle portion, comprising:
  - a generally-oval shaped form sized to accommodate a human hand, and
  - a groove portion shaped to accommodate fingertips of the human hand;
- a neck portion, comprising a tapered form, and
  - a connector portion, comprising:
  - an open-ended, generally cylindrical connector having a wall portion with circumference defining an open longitudinal portion, the connector forming a channel for seating the trombone slide handle,
  - the open longitudinal portion defining wall ends of the wall portion, the connector sized to accommodate a trombone slide handle and to securely hold the slide handle, the wall ends capable of separation to attach to and be removed from the trombone slide handle, and
  - a flexible lip formed at one of the wall ends, the lip, when operated, causing the wall ends to spread apart to accommodate the trombone slide handle, wherein the wall ends close toward each other when the trombone slide handle seats in the connector.

8. The trombone slide extension handle of claim 7, wherein the neck portion comprises a bi-planar, dog-leg form.

9. The trombone slide extension handle of claim 7, wherein the neck portion comprises a curved form.

10. A trombone slide extension handle, comprising:
- a handgrip portion;
- a slide handle connection portion pivotably connectable to a trombone slide handle, comprising:
  - a connector having a cylindrical form open on its ends and open longitudinally along a length of the connector, and
  - the opening is capable of enlarging to accommodate the trombone slide handle; and
- a neck portion connecting the handgrip portion and the connector portion.

* * * * *